US006009996A

United States Patent [19]

Purdy

[11] Patent Number: 6,009,996

[45] Date of Patent: Jan. 4, 2000

[54] CASE FOR A TAKEN DOWN SHOTGUN

[76] Inventor: Vernon J. Purdy, 1900 E. Girard Pl., Suite 509, Englewood, Colo. 80110

[21] Appl. No.: 09/093,063

[22] Filed: Jun. 8, 1998

Related U.S. Application Data

[63] Continuation-in-part of application No. 08/827,936, Jan. 29, 1997.

[51] Int. Cl.[7] ..... B65D 85/00

[52] U.S. Cl. ..... 206/317; 224/913

[58] Field of Search ..... 206/317; 224/913; D3/262

[56] References Cited

U.S. PATENT DOCUMENTS

| | | | |
|---|---|---|---|
| 784,901 | 3/1905 | Sheldon | 206/317 |
| 873,786 | 12/1907 | Reuter | 206/317 |
| 1,149,690 | 8/1915 | Saffold | 206/317 |
| 1,187,652 | 6/1916 | Reuter | 206/317 |
| 2,531,550 | 11/1950 | Bradley et al. . | |
| 2,542,667 | 2/1951 | Hanson . | |
| 2,574,730 | 11/1951 | Crew et al. . | |
| 2,706,036 | 4/1955 | Neal . | |
| 2,781,897 | 2/1957 | Dale . | |
| 2,872,960 | 2/1959 | Kolpin . | |
| 3,191,652 | 6/1965 | Benson et al. | 206/317 |
| 3,780,487 | 12/1973 | Munson | 206/317 X |
| 3,865,166 | 2/1975 | Pedro . | |
| 3,907,108 | 9/1975 | Weimer, Jr. | 206/317 |
| 4,446,900 | 5/1984 | Markovich . | |
| 4,475,247 | 10/1984 | Lee | 206/317 X |

*Primary Examiner*—Bryon P. Gehman

*Attorney, Agent, or Firm*—Donald W. Margolis; Emery L. Tracy

[57] ABSTRACT

A carrying case assembly for carrying a shotgun is provided. The shotgun is disassemblable into a barrel subassembly and a stock-receiver subassembly. The case assembly comprises an outer case member having a first case member portion and a second case member portion hingedly connected to the first case member portion with the first and second case member portions being closable together defining a compartment. An insert member is mounted within the compartment and substantially extending from the first case member portion to the second case member portion, the insert member separating and supporting the barrel subassembly and the stock-receiver subassembly.

19 Claims, 3 Drawing Sheets

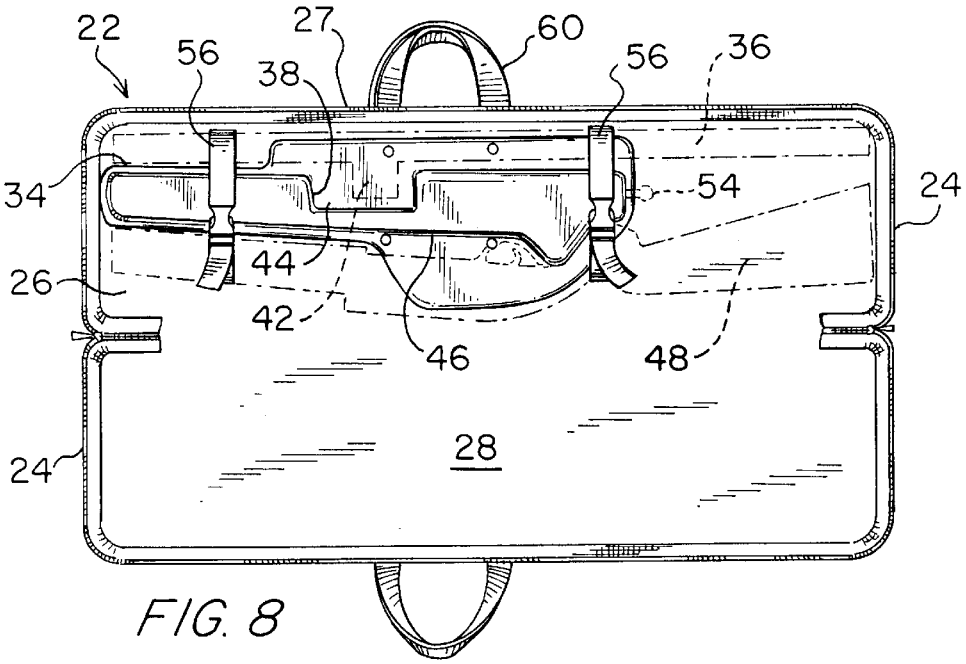
FIG. 8
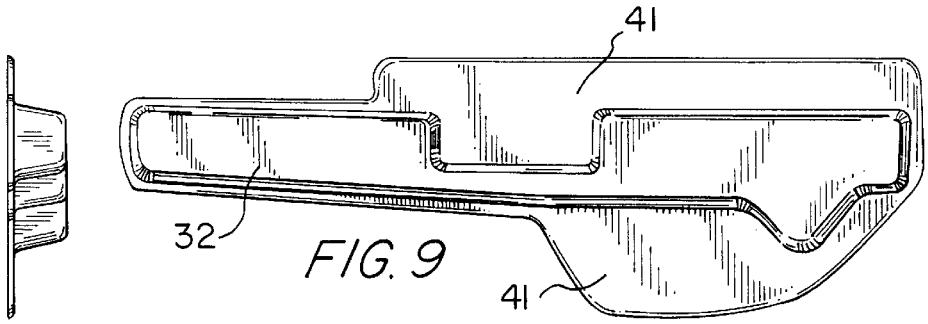
FIG. 9
FIG. 11
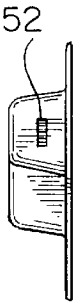
FIG. 12
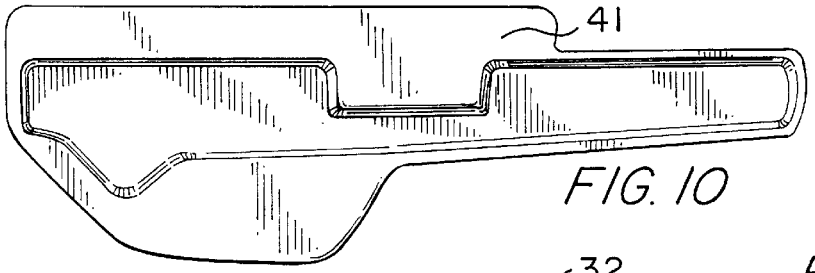
FIG. 10
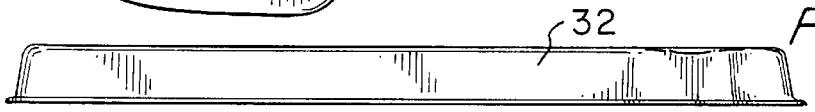
FIG. 13
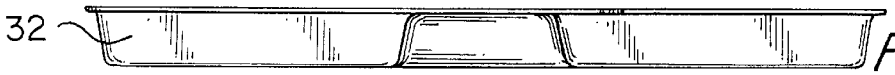
FIG. 14

CASE FOR A TAKEN DOWN SHOTGUN

CROSS REFERENCE TO RELATED APPLICATIONS

This is a continuation in part application of U.S. patent application Ser. No. 08/827,936 filed Jan. 29, 1997, and still pending.

BACKGROUND OF THE INVENTION

1. Field of the Invention

This invention relates to a receptacle for a weapon. More specifically it relates to a carrying cases for the most popular types of shotguns, and specifically to a case for taken-down pump shotguns, auto-loading action shotguns, and breaking action shotguns.

2. Discussion of the Prior Art

Shotgun carrying cases are widely available in a broad range of styles and designs. The two broad categories of shotgun carrying cases are hard-sided and soft-sided, with the latter including flexible cases. Each of these categories of carrying cases can further be described as full length gun or taken down gun carrying cases. At this time, no soft-sided taken down case is known to be available for the two most popular types of taken-down shotguns, the auto loader action shotgun and the pump action shotgun. This is apparently due to the fact that the size and shape of the sub-assemblies of the taken-down shotgun, i.e. the barrel and the stock-receiver sub-assembly with magazine tubes, do not lend themselves to be inserted into and removed from the end loading design of currently available taken-down shotgun soft carrying cases which are used for side by side and over/under breaking action shotguns. This leaves the full length, soft shotgun carrying cases as the only available soft-sided or flexible shotgun carrying case option.

The main disadvantage of full length shotgun carrying cases is that the case length usually exceeds fifty inches (50"). This length makes the carrying cases cumbersome to carry, for example through doorways and narrow halls, and also difficult to store and to haul in most vehicles. The hard-sided full length carrying cases have the same disadvantages of length. In addition, hard-sided full length carrying cases are usually quite heavy, and therefore impractical for their primary purpose, carrying. Also, hard-sided carrying cases are usually very expensive when compared to soft-sided cases.

In the prior art Hanson, U.S. Pat. No. 2,542,667, describes a gun carrying case having an elongated rigid bar with a downwardly extending arm at its rear end forming a forwardly facing socket to receive the butt end of the stock of the gun. While the rigid bar of the Hanson patent encases the rifle to prevent movement and to protect the rifle, the Hanson patent is specifically designed and intended as being a full length rifle carrying case, with all of the inherent failings noted above.

Accordingly, there exists a need for a softsided case for a taken down shotgun which can accommodate the barrel and the stock-receiver sub-assembly with magazine tubes of the auto loader action shotgun and the pump action shotgun. Additionally, there exists a need for a softsided case for a taken down shotgun which has a length which is less than the length of full length shotgun carrying cases. Furthermore, there exists a need for a softsided case for a taken down shotgun which prevents movement of the shotgun and protects the shotgun for damage.

SUMMARY OF THE INVENTION

The present invention relates to soft-sided carrying cases for the most popular types of taken down shotguns, that is pump action, auto-loading action, and breaking action shotguns. The invention consists of a light weight, softsided, substantially flexible case with a circumferential closure around its open sides. The closure is designed to allow the case to be fully opened and laid flat. Attached to, and located on the inside of the case is a light weight 3-Dimensional insert member which is shaped to universally accommodate the taken-down sub-assemblies of either a pump action shotgun, or of an auto loading action shotgun, or of a breaking action shotgun. In preferred embodiments the light weight insert member is formed from an elastomeric material. There are at least two adjustable securing straps with releasable closures which are associated with the insert member for use in securing the taken-down sub-assemblies to the insert member. This allows the shotgun to be viewed while still secured within the opened case. Furthermore, once the shotgun sub-assemblies are secured to the insert member and the case closed, the carrying case subsumes the inherent strength and rigidity of the shotgun sub-assembly, thereby providing substantial stability to the combination, yet in a softsided case which is of a more convenient size, shape and weight as compared to a full length or hard-sided case.

The case also has one or more carrying handles, preferably located near what will be the weight balance point of the case when carrying the shotgun taken-down sub-assemblies. The handle may be positioned to allow the presentation of unobstructed graphics, including advertising, on the side of the case. By making the appropriate choice of materials, the case, when carrying shotgun sub-assemblies, will float when dropped in water, and is inexpensive when compared to the cost of a hard-sided case. In addition, the case is easily lockable using existing luggage zipper locks or built in locks. When required, an internal holder or case, either permanent or detachable, may be provided within the case for extra choke tubes or other items which are desirable to store inside the case.

It will be readily understood that the 3-Dimensional insert member of the present invention may be modified to accommodate all popular shotgun models, brands and gauges, and also be modified to accommodate new and different shotgun designs, sizes and shapes.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which:

FIG. 8 is a front plan view of the carrying case for a shotgun, similar to FIG. 2, illustrating the carrying case when carrying an auto loading or pump action shotgun secured to a 3-dimensional insert member, the shotgun stock and receiver sub-assembly, and the shotgun barrel sub-assembly being illustrated in phantom for illustrative purposes only, and not constituting a part of the invention;

FIG. 9 is an enlarged front elevational view of the 3-Dimensional insert member illustrated in the open carrying case for a shotgun illustrated in FIG. 8 of my new design;

FIG. 10 is a rear elevational view of the insert member illustrated in FIG. 8;

FIG. 11 is a left side elevational view of the insert member illustrated in FIG. 8;

FIG. 12 is a right side elevational view of the insert member illustrated in FIG. 8;

FIG. 13 is a bottom plan view of the insert member illustrated in FIG. 8;

FIG. 14 is a top plan view of the insert member illustrated in FIG. 8.

DETAILED DESCRIPTION OF THE PREFERRED EMBODIMENTS

Figure 1:
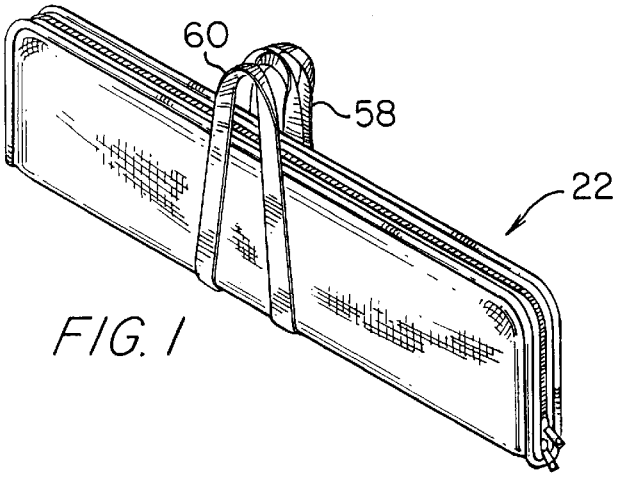
FIG. 1 is a top right perspective view of the flexible case for a taken down shotgun in a closed position constructed in accordance with the present invention.
Figure 4:
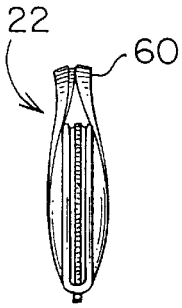
FIG. 4 is a left side elevational view of the carrying case for a shotgun constructed in accordance with the present invention.
Figure 2:
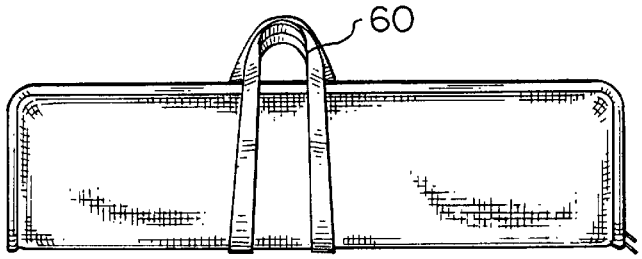
FIG. 2 is a front elevational view of the carrying case for a shotgun constructed in accordance with the present invention.
Figure 5:
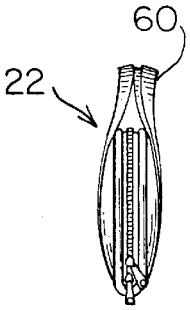
FIG. 5 is a right side elevational view of the carrying case for a shotgun constructed in accordance with the present invention.
Figure 6:
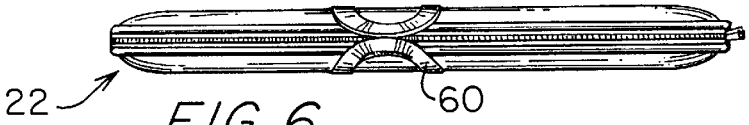
FIG. 6 is a top plan view of the carrying case for a shotgun constructed in accordance with the present invention.
Figure 3:
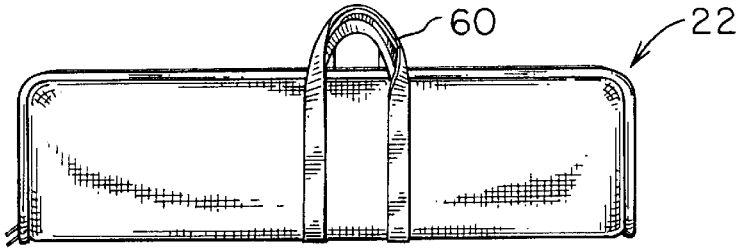
FIG. 3 is a rear elevational view of the carrying case for a shotgun constructed in accordance with the present invention.
Figure 7:
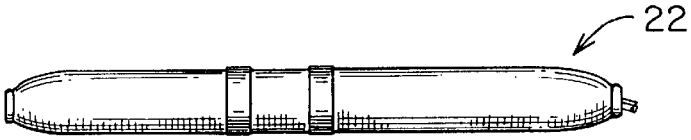
FIG. 7 is a bottom plan view of the carrying case for a shotgun constructed in accordance with the present invention.

As illustrated in FIGS. 1–7, the present invention is comprised of a light weight, flexible, softsided case 22. Typically case 22 has a zipper closure 24 on three sides for use in opening and closing case 22, although other types of closure mechanisms may be used. Zipper closure 24 allows case 22 to be fully opened and laid flat, as illustrated in FIG. 8. When case 22 is open, case 22 has two internal sides, an upper portion 26 and a lower portion 28. Upper portion side 26 has secured within it a light weight 3-Dimensional insert member 32. Insert member 32 is shaped to substantially universally accommodate the taken-down sub-assemblies of either a pump shotgun or of an auto loading shotgun.

As is most clearly illustrated in FIGS. 8 and 13, the upper surface 34 of insert member 32 provides support for a shotgun barrel 36 illustrated in phantom in FIG. 8. Opening 38 which extends downward from upper surface 34 of insert member 32 is of sufficient length that it can accommodate substantially any size and shape bracket 42 carried by shotgun barrel 36. In preferred embodiments elastomeric spacing material 44 can be cut to any length to custom fit and firmly receive and grip any shot gun barrel bracket 42 placed in opening 38.

The lower surface 46 of insert member 32 is universally shaped to receive and make contact with the stock grip, trigger guard and forearm 48, illustrated in phantom in FIG. 8, of substantially any auto-loading shotgun or pump action shotgun. Insert member 32 includes a surrounding flange 41. Flange 41 is of at least sufficient width and rigidity to provide stability to insert member 32 and to sub-assemblies 36 and 48, when they are secured thereto, and while shown as only surrounding insert member 32, it may in fact be enlarged. Such enlargement of flange 41 may be, for example, only sufficient to extend below the full length of shotgun barrel 36, or even be extended so that it would completely cover the inner surface of one half of upper portion side 26. In preferred embodiments, the light weight 3-dimensional insert member is formed from an elastomeric material. As illustrated in FIG. 11, a slot 52 is provided in the right side of insert member 32 to receive and hold a bolt handle 54 of the type associated with auto-loading action shotguns.

In preferred embodiments, there are at least two adjustable securing straps 56 with releasable closures which are attached to insert member 32 for use in securing the shotgun taken-down sub-assemblies 36 and 48 to the insert member 32. As illustrated in FIG. 8 straps 56 are connected to insert member 32 at its right and left ends and can be secured and tightened around insert member 32, barrel sub-assembly 36 and stock and receiver sub-assembly 48 to connect them together so that barrel 36 and stock and receiver sub-assembly 48 are secured against both vertical and horizontal movement. This also allows the shotgun sub-assemblies 36 and 48 to be substantially fully viewed while still secured within the open case 22. Furthermore, once the shotgun sub-assemblies 36 and 48 are secured to insert member 32 the carrying case shares the inherent strength of the shotgun sub-assembly, thereby providing substantial stability to the combination, in a soft case which is lightweight and of a convenient size and shape as compared to a full length case.

Case 22 also includes one or more carrying handles 60 on the outside of upper side 26. In one embodiment of the case 22 of the present invention, the handle 60 on the exterior of side 26 is connected through case 22 and attached to insert member 32. In this construction, the handle 60 provides direct support to insert member 32 and any taken-down sub-assemblies which it is carrying rather than being supported solely by the fabric of case 22.

In another embodiment of the present invention, the handles 60 are connected to a top side 27 of the case 60. Regardless of the embodiment of the case 22 of the present invention, the handles 60 are preferably located near what will be the weight balance point of the case 22 when carrying the taken-down sub-assemblies. The handle may be positioned and rigged to allow graphic, including advertising, on the side of the case.

It is, therefore, seen that the case of the present invention provides a case with a rectangular silhouette, which secures shotgun sub-assemblies against both vertical and horizontal movement. In addition, case 22 can be carried by handle 60 on only one side of case 22, and if case 22 is opened, either intentionally or unintentionally the shotgun sub-assemblies 36 and 48 will neither move nor fall out of the case.

Figure 15:
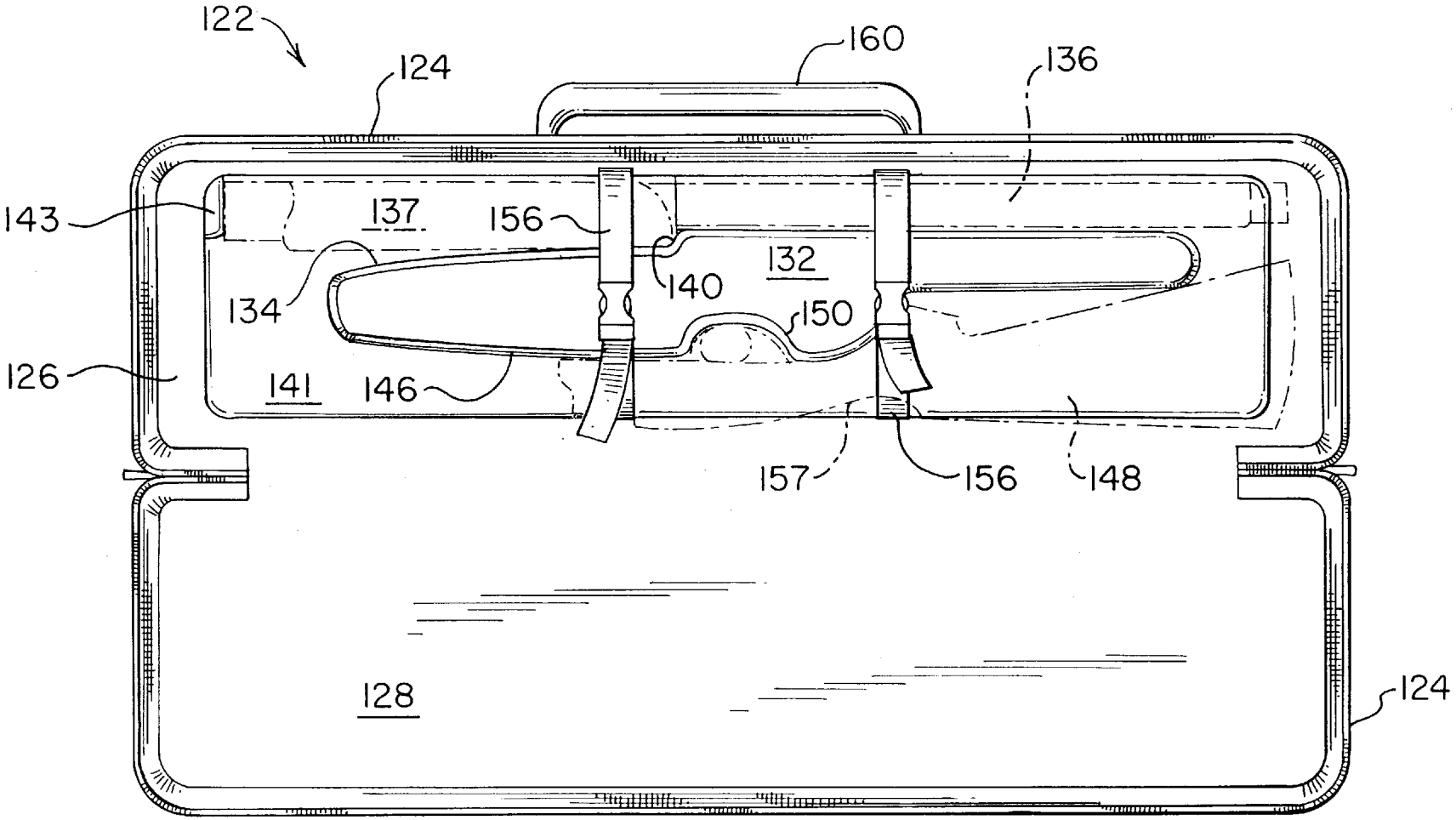
FIG. 15, is a front plan view of a modified carrying case for a shotgun, similar to FIG. 8, illustrating the present invention when carrying the sub-assemblies of a breaking action shotgun secured to a modified 3-dimensional insert member, the shotgun barrel and forearm sub-assembly and stock and receiver sub-assembly both being illustrated in phantom for illustrative purposes only, and not constituting a part of the invention.

Referring now to FIG. 15, a modified version of the light weight, flexible case of the present invention is illustrated, in which the numbered elements of the case and insert member of FIGS. 1–14 are generally the same, but with 100 added to each element, and in some instances with new element numbers added. As in the first version, case 122 also has a zipper closure 124 on three sides which allows case 122 to be fully opened and laid flat, as illustrated in FIG. 15. When case 122 is open it has two internal sides, an upper portion 126 and a lower portion 128. Side 126 has secured within it a modified 3-dimensional light weight insert member 132 which is specifically designed to universally accommodate and provide a nest for the sub-assemblies of the type of shotgun known as a breaking action shotgun.

As is illustrated in FIG. 15, the upper surface 134 of insert member 132 provides a complementary support for a combined shotgun barrel 136 and forearm 137 sub-assembly of a breaking action shotgun, the latter being shown in phantom. Notch 140 in the upper surface 134 of insert member 132 accommodates the forearm portion 137 of the breaking action shotgun sub-assembly which is attached to the barrel sub-assembly 136, thereby preventing this sub-assembly from sliding to the right. Insert member 132 also includes a surrounding and stabilizing flange 141. In this embodiment a ridge 143 is supported at the top left end of flange 141. Ridge 143 prevents sub-assembly 136-137 from sliding to the left, and together with notch 140 stabilizes and prevents horizontal movement of sub-assembly 136-137. In preferred embodiments, flange 141 also includes a slightly raised platform, not shown, in the area below barrel 136 to provide contact with and therefore additional stability to barrel 136.

The lower surface 146 of insert member 132 is universally shaped to receive and make contact with the stock and receiver sub-assembly 148, illustrated in phantom in FIG. 15, of substantially any breaking action shotgun. Lower surface 146 includes a depression 150 for receiving any breaking action shotgun trigger guard. As further illustrated in FIG. 15, lower surface 146 also includes a contour to receive and universally accommodate the grip portion of the shotgun stock behind the receiver of any breaking action shotgun. As with insert member 32, the light weight insert member illustrated FIG. 15 is also preferably formed from an elastomeric material.

In the modified version illustrated in FIG. 15, adjustable securing straps 156 with releasable closures are attached to insert member 132 at the edges of flange 141 for use in securing the shotgun taken-down sub-assemblies 136-137 and 148 to the insert member. As illustrated in FIG. 15, straps 156 are connected to insert member 132 to the right and left, but in this instance the right strap is to the right of notch 140 and the left strap straddles the saddle 157 of the stock grip portion of sub-assembly 148. Straps 156 can be secured and tightened around insert member 132, barrel sub-assembly 136-137 and sub-assembly 148 to connect them together so that barrel forearm sub-assembly 136-137 and sub-assembly 148 are secured against movement in all directions. Case 122 also includes one or more carrying handles 160 on the outside of upper side 126 or a top side 127, and preferably connected directly to insert member 132 for direct carrying support of the insert member and any shotgun sub-assemblies that it may be carrying.

It will be appreciated that the insert members 32 and 132 can be used separately from cases 22 and 122, for example in other cases, including hard-sided and soft-sided cases of all kinds. In preferred embodiments, insert members 32 and 132 and flanges 41 and 141 may also be covered or decorated, for example with a flexible cloth, two way stretchable cloth being preferred. Insert members 32 and 132 can also be affixed to any surface, for example to a wall or within a cabinet or closet for use in storing a taken down gun. It will be further appreciated that the carrying case for a shotgun, and the insert member of my invention may be modified and changed for use with other break apart guns without departing from the scope of the invention as defined by the claims.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A softsided carrying case assembly for carrying a disassembled gun, the gun disassemblable into at least a barrel subassembly having a length, a width and a cross-section height, and a stock-receiver subassembly having a length, a width and a cross-section height, the softsided case assembly comprising:

a carrying case member having a first case member portion, and a second case member portion, each case member portion defining a width dimension and a length dimension for said carrying case member, the length dimension being longer than the width dimension, said first and second case member portions each having an outer surface and an inner surface, said first and said second case member portions each having substantially the same width and length dimensions and each being substantial mirror images of the other;

a foldable connection portion connected to said first case member portion and said second case member portion, said first and second case member portions being matingly foldable together about said foldable connection portion in a manner such that the inner surfaces of both said first case member portion and said second case member portion define a compartment;

an insert member for separating a barrel subassembly and a stock-receiver subassembly of a to-be-carried disassembled gun, said insert member secured to one of said case member inner surfaces, said insert member having a width dimension aligned with said width dimension of said case member, a length dimension aligned with said length dimension of said case member, and a height dimension which is substantially equal to or greater than the greater of the cross-section heights of a barrel subassembly and of a stock-receiver subassembly of a to-be-carried disassembled gun, the height of said insert member extending from said first case member portion inner surface to said second case member portion inner surface, said insert member also having a first edge along its length for receiving a barrel subassembly of a to-be-carried disassembled gun, and a second edge along its length separated from and opposed to said first edge of said insert member for receiving and separating a stock-receiver subassembly of a to-be-carried disassembled gun from a barrel subassembly within said compartment defined by said first case member portion and said second case member portion;

whereby, when a disassembled gun barrel subassembly is placed along said first edge of said insert member and a disassembled stock-receiver subassembly is placed along said separated and opposed second edge of said insert member, and said first case member portion and said second case member portion are matingly folded together about said foldable connection portion, a softsided carrying case assembly is provided for carrying a disassembled gun.

2. The case assembly of claim 1 wherein the to-be-carried barrel subassembly includes a barrel portion and a bracket portion and the to-be-carried stock-receiver subassembly includes a stock grip, a trigger guard, a forearm, and a receiver portion, and further wherein said first edge of said insert member is substantially contoured to receive and nest with a barrel subassembly barrel portion and bracket portion and wherein said second edge of said insert member is substantially contoured to receive and nest with a to-be-carried stock-receiver subassembly stock grip, trigger guard, forearm, and receiver portion.

3. The case assembly of claim 2 and further comprising an indentation in the first edge of said insert member, said indentation being substantially contoured to receive and nest with a to-be-carried bracket portion of a barrel subassembly.

4. The case assembly of claim 3 and further comprising spacing material within said indentation located to substantially surround the bracket portion of the barrel subassembly of a to-be-carried gun.

5. The case assembly of claim 1 wherein the barrel subassembly of a to-be-carried gun includes a barrel portion and a forearm portion and the stock-receiver subassembly of a to-be-carried gun includes a stock grip, a trigger guard, and a receiver portion, and further wherein said insert member has a first edge and a second edge substantially opposite to and spaced from said first edge, said first edge substantially contoured to receive, nest with and support the barrel subassembly, said second edge substantially contoured to receive, nest with and support the stock-receiver subassembly.

6. The case assembly of claim 5 and further comprising a notch formed in said first edge of said insert member, said notch substantially contoured to receive, nest with and support the forearm portion of the barrel subassembly of a to-be-carried gun.

7. The case assembly of claim 5 and further comprising a depression formed in said second edge of said insert member, said depression substantially contoured to receive, nest with and support a trigger guard of a stock-receiver subassembly of a to-be-carried gun.

8. The case assembly of claim 5 and further comprising a contour formed in said second edge of said insert member, said contour designed to receive, nest with and support a grip portion of a stock-receiver subassembly of a to-be-carried gun.

9. The case assembly of claim 1 and further comprising a flange surrounding at least a portion of said insert member, said flange substantially contoured to receive and to support at least a portion of the barrel subassembly and a portion of the stock-receiver subassembly of a to-be-carried gun.

10. The case assembly of claim 9 and further comprising a ridge formed on said flange to inhibit movement of the barrel subassembly of a to-be-carried gun.

11. The case assembly of claim 1 wherein said insert member is constructed from an elastomeric material.

12. The case assembly of claim 1 and further comprising a slot formed in said insert member for holding a bolt handle of the gun.

13. The case assembly of claim 1 and further comprising securing means located for releasably securing the barrel subassembly of a to-be-carried gun and securing means located for releasably securing the stock-receiver subassembly of a to-be-carried gun to said insert member.

14. The case assembly of claim 1 and further comprising at least one carrying handle mounted to said case assembly, said at least one carrying handle being positioned near a weight balance point of said case assembly.

15. The case assembly of claim 1 wherein said case member is comprised of a flexible material.

16. The case assembly of claim 1 wherein said first case member portion, said second case member portion and said foldable connection portion are a substantially unitary structure.

17. A softsided carrying case assembly having a compartment defined by a first case member having a substantially flat surface and a second case member having a substantially flat surface and hingedly connected to the first case member, the softsided carrying case assembly for carrying a gun which is disassemblable into a barrel subassembly and a stock-receiver subassembly, said softsided carrying case assembly including:

a single piece, unitary insert member mounted within the compartment and secured directly to said substantially flat surface of one of the first case member portion and the second member case member portion, said single piece, unitary insert member having a first side edge and a second side edge spaced from and opposed to said first side edge, said first side edge of said single piece, unitary insert member sized and shaped to nestingly support the barrel subassembly of a to-be-carried gun, said second side edge of said insert member sized and shaped to nestingly support the stock-receiver subassembly of a to-be-carried gun.

18. A softsided carrying case assembly for carrying a gun, the gun disassemblable into a barrel subassembly and a stock-receiver subassembly, said softsided carrying case assembly comprising:

a compartment defined by a first case member and a second case member, said second case member hingedly connected to said first case member;

a single piece, unitary insert member mounted within said compartment and secured to one of said first case member portion and said second member case member portion, said single piece, unitary insert member having a first side edge and a second side edge spaced from and opposed to said first side edge, said first side edge of said single piece, unitary insert member sized and shaped to nestingly support the barrel subassembly of a to-be-carried gun, said second side edge of said single piece, unitary insert member sized and shaped to nestingly support the stock-receiver subassembly of a to-be-carried gun.

19. The case assembly of claim 18 and further comprising securing means located for releasably securing the barrel subassembly of a to-be-carried gun and securing means located for releasably securing the stock-receiver subassembly of a to-be-carried gun to said insert member.

* * * * *